United States Patent [19]

Conn

[11] 4,008,901

[45] Feb. 22, 1977

[54] TRIPLE SKATE ATTACHMENTS

[76] Inventor: John L. Conn, Maple Terrace Drive, Apt. 14, Corbin, Ky. 40701

[22] Filed: June 11, 1975

[21] Appl. No.: 586,086

[52] U.S. Cl. ..... 280/7.13; 280/11.3

[51] Int. Cl.[2] ..... A63C 17/18

[58] Field of Search ..... 280/7.13, 11.1 R, 8, 280/9, 10, 11.3

[56] References Cited

UNITED STATES PATENTS

| | | | |
|---|---|---|---|
| 945,435 | 1/1910 | Anderson | 280/7.13 |
| 1,266,386 | 5/1918 | Barr | 280/7.13 |
| 1,773,303 | 8/1930 | Duff | 280/11.3 |
| 2,095,942 | 10/1937 | Wetterstrand | 280/7.13 |
| 2,706,119 | 4/1955 | Uphoff | 280/11.12 |
| 2,868,553 | 1/1959 | Rieckman | 280/7.13 |
| 3,026,118 | 3/1962 | Pare | 280/7.13 |
| 3,292,940 | 12/1966 | Weitzner | 280/7.13 |
| 3,351,353 | 11/1967 | Weitzner | 280/7.13 |
| 3,884,485 | 5/1975 | Walle | 280/11.1 R |

*Primary Examiner*—Joseph F. Peters
*Assistant Examiner*—David M. Mitchell

[57] ABSTRACT

An improved method of securing and/or fastening the two designs of skates; the ice skate and the wheel type roller skate into one shoe attachment design and invention so as to use the one pair of skating shoes for the dual skating purpose. The skates thus being manufactured or constructed with the attachments so as to be connected to the one pair of skating shoes, thus one pair of skating shoes to be used for both types of skating wherein the street shoe sole attachment can be connected to said shoe so as to use as the common street shoe, thus the triple skates attachments.

3 Claims, 7 Drawing Figures

TRIPLE SKATE ATTACHMENTS

This invention relates generally and more particularly to the triple attachments for attaching either of the two skates designs into one connecting shoe attachments and also the connecting of the common street shoe sole attachment. A principle object of the present invention is to provide an improved ice or roller skates and/or walking sole attachments.

Another object is to provide a one pair of skating shoes that can then be used for either ice skating or roller skating or walking.

Another object is to provide a pair of ice skates attachments that has the present invention attachments so as to connect and fasten to the one skating shoe.

Another object is to provide a pair of roller skate attachments that has the present attachments so as to connect and fasten invention to the one skating shoes.

Another object of the present invention is to provide a street shoe sole attachments that has the present attachments so as to connect and fasten to the same skating shoe for street use.

Another object is to provide an improved triple method and attachments for dual skating purposes and walking which is simple in design, inexpensive to manufacture, rugged in construction, easy to use and efficient in operation.

These and other objects will be readily evident upon a study of the following specifications and the accompanying drawings wherein.

Figure 1:
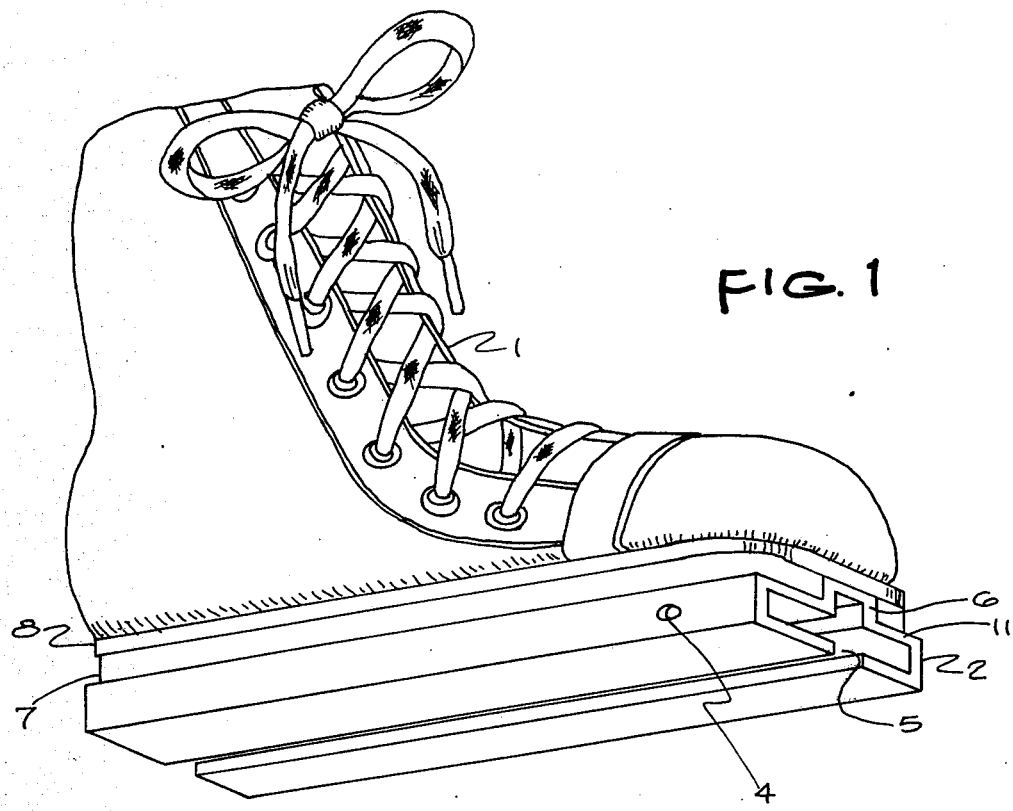
FIG. 1 is a view of the skate shoe with the locking attachment built into the sole area of the shoe.
Figure 2:
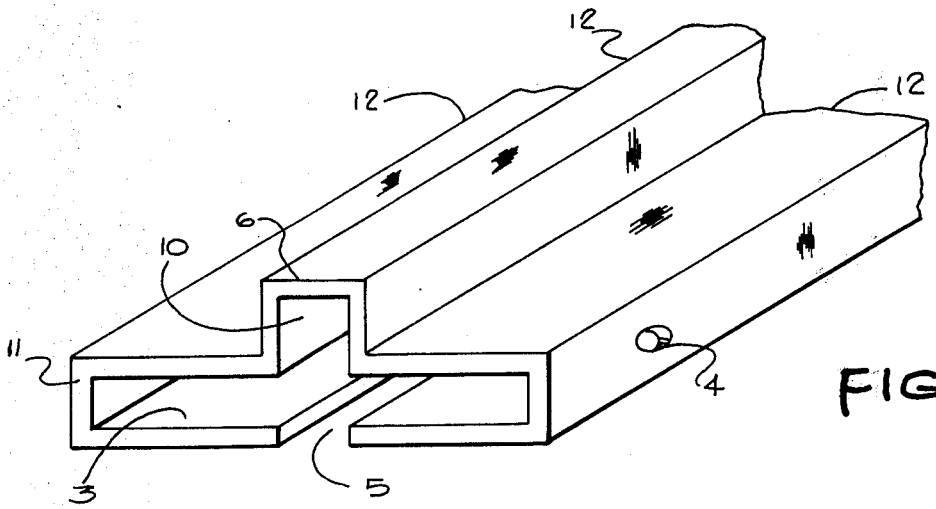
FIG. 2 is a view of the locking attachment that is built into the shoe sole construction.
Figure 3:
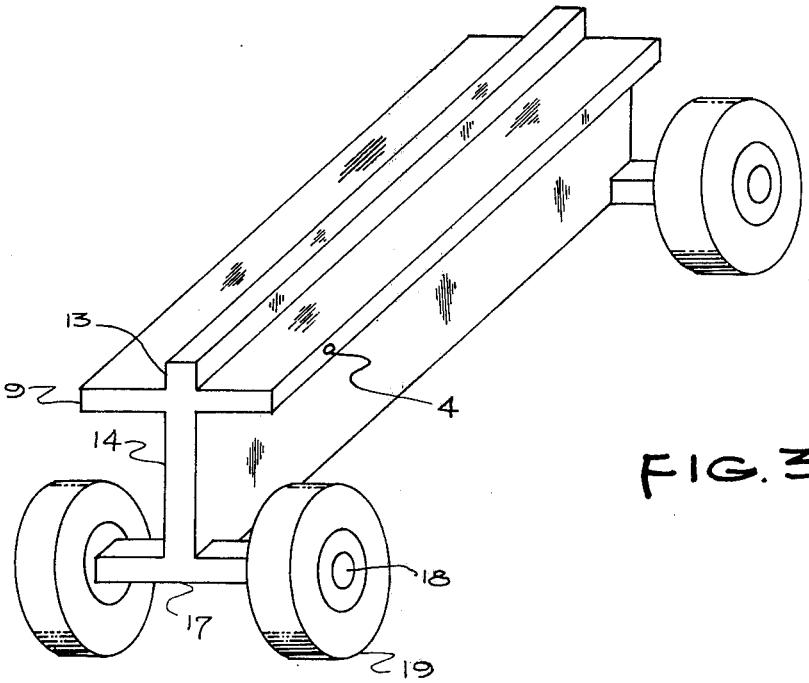
FIG. 3 is a view of the roller skate attachment.

Referring now to the drawing, and more particularly to FIG. 1 and FIG. 2 thereof, at this time, the reference number (1) represents a skating shoe wherein the shoe (1) has a sole constructed locking or connecting attachment, FIG. 2, according to the present invention.

The attachments that are built into or constructed in the present design of the ice skates FIG. (4) and the roller skates FIG. (3) and the walking street shoe FIG. (6) have the inter locking arms (9 & 13) made so to inter lock with the locking shoe groove or slots (3 & 10). This attachment locking arm (9) consists of the base attachment support (14) that is secured to the ice skate blade (16) and to the roller skate wheels (17, 18, and 19) and the walking shoe sole (20 & 21) to secure this inter locking attachment and for balance, the extended arm (13) will thus give the attachments stability when connected with this inter locking slot (10) of the shoe sole attachment FIG. 2).

The shoe attachment consists of the built in base attachment to the shoe (2) wherein on the side support base has the hole area (4) so that the attachment can be locked and secured in place. The groove or slot area (5) will give additional stability when that portion of the skate attachment (14) is locked or inserted here. The built into connecting area (6 & 12) will then secure the attachment to the shoe sole area all along the shoe sole at areas (7 & 8) also.

The inter locking arms of the skate attachments (9 & 13) will inter lock with the shoe attachment at slot areas (10 & 3), thus the inter locking arms (9 & 13) will be housed or contained by the slot sides (2 & 11).

To prepare the skate for use, the particular design of skate is inserted into the shoe attachment at the slot areas (3, 5, & 10) by inserting (9, 13, & 14) within the side of the arms 13 & 14) wherein this will also help secure the skate to the shoe and when the skate is in proper place the fastening bolt will thus screw through the threaded holes (4) of the attachments (11 & 9) so as to lock the two as one.

The extended arm (13) of the skate attachment can be deleted and thus a modified design as per FIG. (5).

Figure 4:
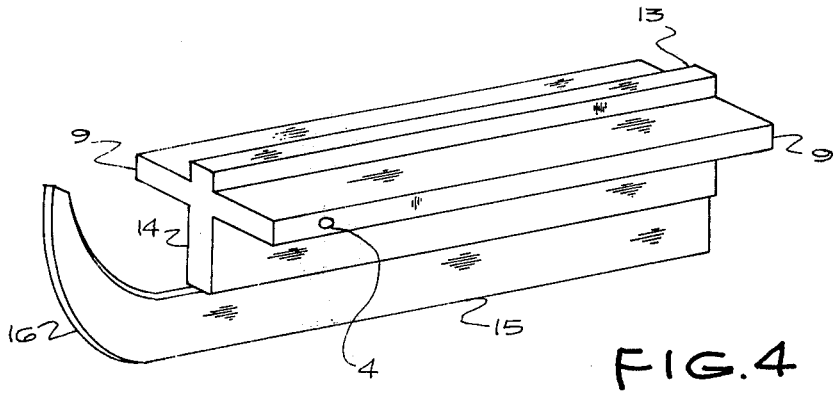
FIG. 4 is a view of the ice skate attachment.
Figure 5:
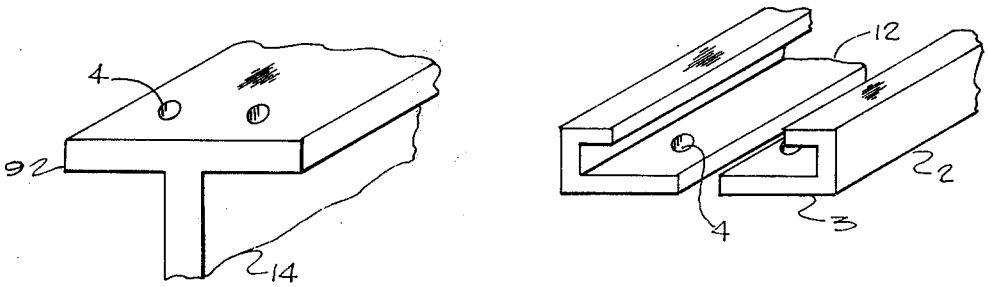
FIG. 5 is a view of a modified locking or connecting attachments.
Figure 6:
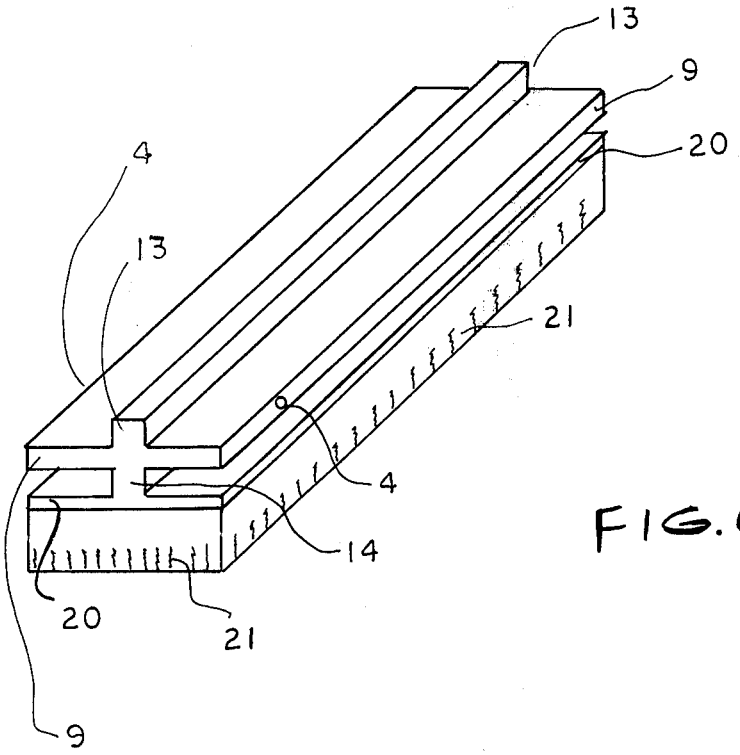
FIG. 6 is a view of the walking shoe sole attachment.
Figure 7:
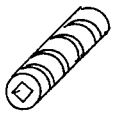
FIG. 7 is a view of the lock bolt.

The ice skate attachments (FIG. 4), and the roller skate attachments FIG. (3) and the street or walking attachments FIG. (6) are all thus connected in the same manner wherein the walking shoe attachment has the rubber street shoe sole (21) built on to the base shoe sole (20) and connecting attachment arm (14). The tip of the ice skate blade is thus (15).

While various changes may be made in the detail construction it is understood that such changes will be within the spirit and scope of the present invention as is defined by the claims.

What is claimed is:

1. The combination of a shoe and an attachment secured to the shoe for mounting various devices, said shoe including a sole with a longitudinal slot extending the length of the shoe, and said attachment includes a raised longitudinal vertical channel section of inverted U-shape adapted to fit snugly in said slot and having integral symmetrical lateral projections extending transversely from the bottom edges of said channel section, said projections including horizontal lower portions spaced from and parallel to upper portions and vertical members integrally connecting said upper and lower portions, said attachment having a slot, defined by inner edges of the lower portions, vertically aligned with said sole slot, and wherein each of said various devices includes a T-shaped upper locking member comprising a vertical web and symmetrical lateral horizontal wings, the web extending vertically above said wings to be snugly received in the channel section and vertically below said wings to engage the inner edges and be received in said attachment slot, and the wings engage the upper and lower portions of said projections.

2. The combination of claim 1 in further combination with a skating device, wherein said T-shaped upper locking member includes a lower edge surface and said skating device is attached to said lower edge surface.

3. The combination of claim 1 in further combination with a walking device, wherein said T-shaped upper locking member includes a lower edge surface and said walking device is attached to said lower edge surface and further includes a second pair of wings spaced from and parallel to the first said wings, including a walking sole secured to the bottom of said second pair of wings.

* * * * *